United States Patent [19]

Iams et al.

[11] Patent Number: 4,986,261

[45] Date of Patent: Jan. 22, 1991

[54] APPARATUS FOR PERFORMING COORDINATED WALKING MOTIONS WITH THE SPINE IN AN UNLOADED STATE

[75] Inventors: John F. Iams, Poway; Robson L. Splane, Jr., Granada Hills, both of Calif.

[73] Assignee: Superspine, Inc., Poway, Calif.

[21] Appl. No.: 86,314

[22] Filed: Aug. 14, 1987

Related U.S. Application Data

[63] Continuation-in-part of Ser. No. 9,369, Jan. 30, 1987, abandoned.

[51] Int. Cl.[5] ..... A61H 1/02

[52] U.S. Cl. ..... 128/25 R; 272/70; 272/134

[58] Field of Search ..... 272/70, 71, 72, 73, 272/129, 131, 132, 97, 114, 134, 144, 116, DIG. 9; 128/25 R, 70–74, 69, 25 B, 26, 58

[56] References Cited

U.S. PATENT DOCUMENTS

| | | | |
|---|---|---|---|
| 326,247 | 10/1885 | Root . | |
| 2,019,224 | 10/1935 | Hess | 272/71 |
| 2,310,106 | 2/1943 | Miller | 128/58 |
| 2,332,184 | 10/1943 | Sweeney | 128/25 |
| 2,497,391 | 2/1950 | Becker | 272/71 |
| 2,548,408 | 4/1951 | Tammen | 272/144 X |
| 2,565,348 | 8/1951 | Brockman et al. | 128/25 R |
| 2,681,650 | 6/1954 | Goss | 128/33 |
| 3,060,926 | 10/1962 | May | 128/25 |
| 3,074,716 | 1/1963 | Mitchel et al. | 128/25 |
| 3,263,677 | 8/1966 | Pastrick | 128/28 |
| 3,301,553 | 1/1967 | Brakeman | 128/25 R |
| 3,309,084 | 3/1967 | Simmons | 272/132 |
| 3,420,229 | 1/1969 | Miller | 128/71 |
| 3,503,387 | 3/1970 | McAllister | 128/25 R |
| 3,523,524 | 8/1970 | Wilson | 128/58 |
| 3,596,654 | 8/1971 | Tamura | 128/25 |
| 3,695,255 | 10/1972 | Rodgers et al. | 128/25 B |
| 3,731,921 | 5/1973 | Andrews, Jr. | 272/134 |
| 3,777,745 | 12/1973 | Simjian | 272/73 |
| 3,894,534 | 7/1975 | Graves et al. | 128/25 R |
| 4,220,334 | 9/1980 | Kanamoto et al. | 128/26 X |
| 4,235,437 | 11/1980 | Ruis et al. | 272/134 |
| 4,289,309 | 9/1981 | Hoffmann | 272/132 X |
| 4,422,634 | 12/1983 | Hopkins | 272/71 |
| 4,462,252 | 7/1984 | Smidt et al. | 272/DIG. 5 X |
| 4,671,258 | 6/1987 | Barthlome | 128/26 |

*Primary Examiner*—Richard J. Apley
*Assistant Examiner*—H. N. Flaxman
*Attorney, Agent, or Firm*—Stanley A. Becker; Dinah Newton Hill

[57] ABSTRACT

A walking exercise device is disclosed, which allows a user to move through normal walking motions while lying supine in a position of reduced (preferably no) axial gravitational loading on his spine. The device permits prolonged walking without the limitations of spinal vibration and stress and of foot fatigue. Pivoting arm and leg supports are mechanically linked such that the opposing pairs of limbs move in a counter motion to each other as in normal walking. These movements are performed with the assistance of a flywheel to control the walking pace or to provide adjustable resistance against which the user must exert himself. Hinges or a knee flexure roll may be provided to flex the knees and provide foot stroke during each step. The device may be operated by the user's own exertions or may be motor driven for use by infirm persons. Spinal massage mechanism and head and neck traction devices which may be operated simultaneously are also disclosed.

27 Claims, 5 Drawing Sheets

APPARATUS FOR PERFORMING COORDINATED WALKING MOTIONS WITH THE SPINE IN AN UNLOADED STATE

CROSS-REFERENCE TO RELATED APPLICATION

This application is a continuation-in-part of application Ser. No. 07/009,369, filed Jan. 30, 1987 and abandoned on Aug. 31, 1987.

FIELD OF THE INVENTION

The invention herein relates to exercise and physical therapy apparatus. More particularly, it relates to apparatus for movement of a person's limbs in a walking-like manner.

BACKGROUND OF THE INVENTION

It has been recognized for some time that walking is one of the best exercises that a person can perform for therapy and general fitness, if conducted on a regular and continued basis. People who are in good health and physically fit can maintain their condition by regular walking; those who are not physically fit can often significantly improve their fitness and overall physical condition by walking. Walking is also regularly prescribed by physicians for people recovering from surgery or major illnesses such as heart attacks. Walking has an advantage that it can be a low to moderate energy exercise. Also, walking motions are natural to the body, unlike exercises such as rowing, bicycling or nordic skiing. It has been found that if a person is allowed to select his walking pace, he can walk comfortably for a much longer time than he could row, cycle or ski.

Unfortunately, for many reasons most people do not walk regularly for exercise. Perhaps one has a physical infirmity, such as paralysis or loss of a limb. Other reasons may be environmental: people usually do not wish to walk where streets are busy, unsafe, unlighted or do not contain an appropriate sidewalk or footpath for walkers. Finally, even people who would otherwise walk regularly often find their ability to take walks curtailed because of inclement weather, time schedule conflicts or similar reasons.

Ordinary walking has some detrimental aspects. The weight bearing joints (feet, ankles, knees, hips and spine) can be considered to be the "limiting factor" in walking for exercise or therapy. Generally in walking these are the joints which become fatigued because of the stress placed on them at each step. Of course, a person whose feet, ankles, etc. are tired will be unable or unwilling to do more walking, regardless of the generally good condition of the rest of his body.

Also, when one walks he is of course upright and the spinal column is subject to maximum axial gravitational loading. Each step taken imparts vibration and stress to the spinal column. For all walkers the combination of axial gravitational loading, stress and vibration will accelerate the onset of spinal fatigue. In addition, for those with spinal, back or muscle problems, the axial gravitational loading, vibration and stress frequently produce significant pain, such that walking is difficult or impossible.

It would therefore be advantageous to have a device which a person could use indoors and at convenient times and which would allow him to perform the same movements as ordinary walking to obtain the benefits therefrom but without detrimental effects on the spine and feet.

In the past there have been numerous devices described in the literature and patents which have been said to provide walking exercise. Some have simply been treadmills or nordic skiing devices. More pertinent herein are the variety of prior art "walking simulators." A review of typical devices of this type reveals, however, that it has been common to describe virtually any kind of manipulation of the arms and legs, whether in unison or separately, as "simulated walking". Representative of the prior art devices is the device shown in U.S. Pat. No. 3,596,654 in which the arms are moved up and down in the frontal plain in a "wing flapping" motion. Numerous other machines which move the arms and legs are designed to simulate swimming motions, which, of course, require an entirely different set of arm and leg motions from walking. Other devices, such as that shown in U.S. Pat. No. 2,681,650, cause the limbs to be moved in approximately the correct orientation, but the structure is principally designed to provide passive motorized motion to users, such as polio patients, who have little or no use of their limbs. There is only limited provision for a user to initiate movement himself, and such as there is against virtually no resistance so that it can be used by severely crippled individuals for very short periods of time. A related class of devices is exemplified by U.S. Pat. No. 3,060,926 which provides independent and uncoordinated motion to the separate limbs or parts of limbs for users who have no ability to move those limbs. There is no provision for any user initiated motion or for coordinated or multifunctional movement of the limbs.

It would therefore be advantageous to have a device which is multifunctional and can be used equally well by both fit and infirm individuals to perform fully coordinated walking movements. It would also be advantageous to have such a device capable of adjustment so that it could operate over the entire range of effort on the part of the user.

BRIEF DESCRIPTION OF THE INVENTION

The invention herein is a device to permit a person to perform coordinated motions of walking while maintaining his or her spine in a state at least partially free of axial gravitational loading. In its broadest form, the apparatus comprises:

a rigid frame including a generally flat platform at the top thereof, the platform having a surface to support the person from the hips superiorly in a supine position with at least reduced gravitational loading axially along the person's spine, the frame having a right side, a left side, an axial centerline, a shoulder end and a hip end, all corresponding to the location of the counterpart portions of the supported person's body;

a pair of leg supports, each support pivotally mounted to the hip end of the frame and pivotable in a vertical plane, one support disposed on either side of the centerline;

a pair of arm exercisers, one on each side of the centerline, the arm exercisers adapted to move in a generally vertical plane;

linkage means pivoted on the frame and joining the arm exercisers and leg supports to cause the right side arm exerciser and left side leg support to move vertically in one direction and the left side arm exerciser and right side leg support to move vertically in the other direction, all simultaneously, when the apparatus is activated; and inertial means to maintain the simultaneous opposed movement of the linkage means for a prolonged period of time while the person remains in a supine position with the spine in the state of at least reduced axial loading.

Preferably the person reclines horizontally and the spine is in a fully axially unloaded state.

In a specific embodiment the apparatus also contains retarding means against which the user must work to increase the effort on his part to perform the walking motions. In yet another embodiment the apparatus also includes means for flexing the knees as one performs the walking motions, the knee flexion being representative of that which is normal to a walking pace.

DETAILED DESCRIPTION OF PREFERRED EMBODIMENTS

Figure 1:
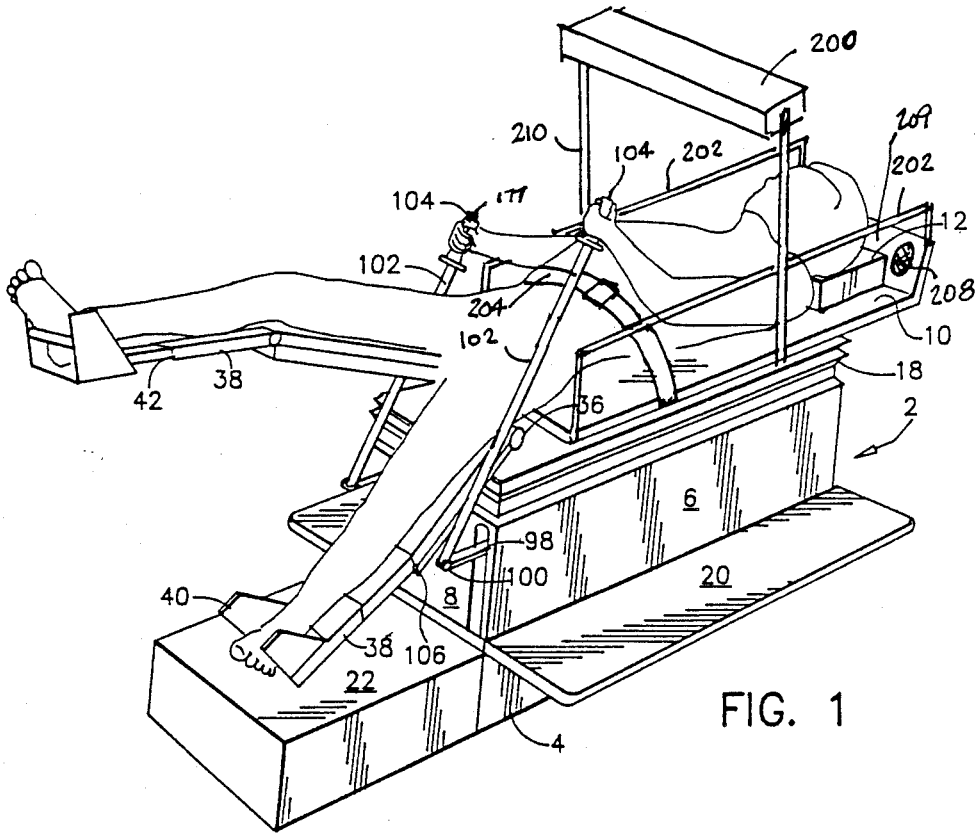
FIG. 1 is a perspective view showing the machine in use with the outer covering panels in place.

The invention is best understood by reference to the drawings. FIG. 1 shows the overall external appearance of the apparatus and typical operation by a user. The device 2 has a generally rectangular housing 4 which consists of side and end panels 6 and 8 and is topped by horizontal platform 10. Platform 10 supports the user's body from the hips upward. It may if desired be at least partially covered by padding 11 for the user's comfort; it is also desirable to include head rest 12 (which may be adjustable) or neck rest 15 to support the user's head. The padding 11 may in turn be covered by different types of fabrics dependent upon the service environment of the device. For instance, it may be advantageous to use a non-absorbent fabric cover which can easily be cleaned, or a disposable absorbent fabric cover which will absorb the user's perspiration and allow him to exercise longer on the device, but which can be readily removed and replaced for a subsequent user. The platform 10 may be changed in elevation above the floor by the telescopic feature 14 of frame 16. Height adjustment of the exterior panels 6 and 8 is by flexible bellows 18. The outer housing 4 may also include steps such as 20 and 22 to enable the user to mount the device easily.

The user lies supine on platform 10 of the device 2 but is in essentially in a walking posture, although that posture can be considered to be translated from the vertical to be horizontal. The operation of this device, which will be described below, causes the user's limbs to move in a coordinated fashion, with the opposed pairs of limbs (left leg and right arm; right leg and left arm) moving in the opposite direction relative to each other just as in walking, with the legs flexing on the forward step and the arms moving in the familiar swinging motion. Because the user is supine, however, all of this walking motion takes place with the user's spine in an axial gravitationally unloaded position. The spine suffers no significant vibration and stress of the type which occur during normal walking. This provides at least two significant benefits: the physically fit user can "walk" vigorously for a prolonged period without any stress being applied to his spine, and the less fit or infirm user whose normal walking has been curtailed by spine related limitations can "walk" with partial or complete freedom from those limitations. In addition, since the feet are not required to support the user's weight or to absorb the normal impacts of walking with this device, the usual limitations on walking caused by foot fatigue are eliminated.

FIG. 1 also illustrates several other features of the device which are significant in various embodiments which will be described below. These include the monitor 200, the restraining rails 202 and the restraining belt 204, as well as speaker 208.

Figure 2:
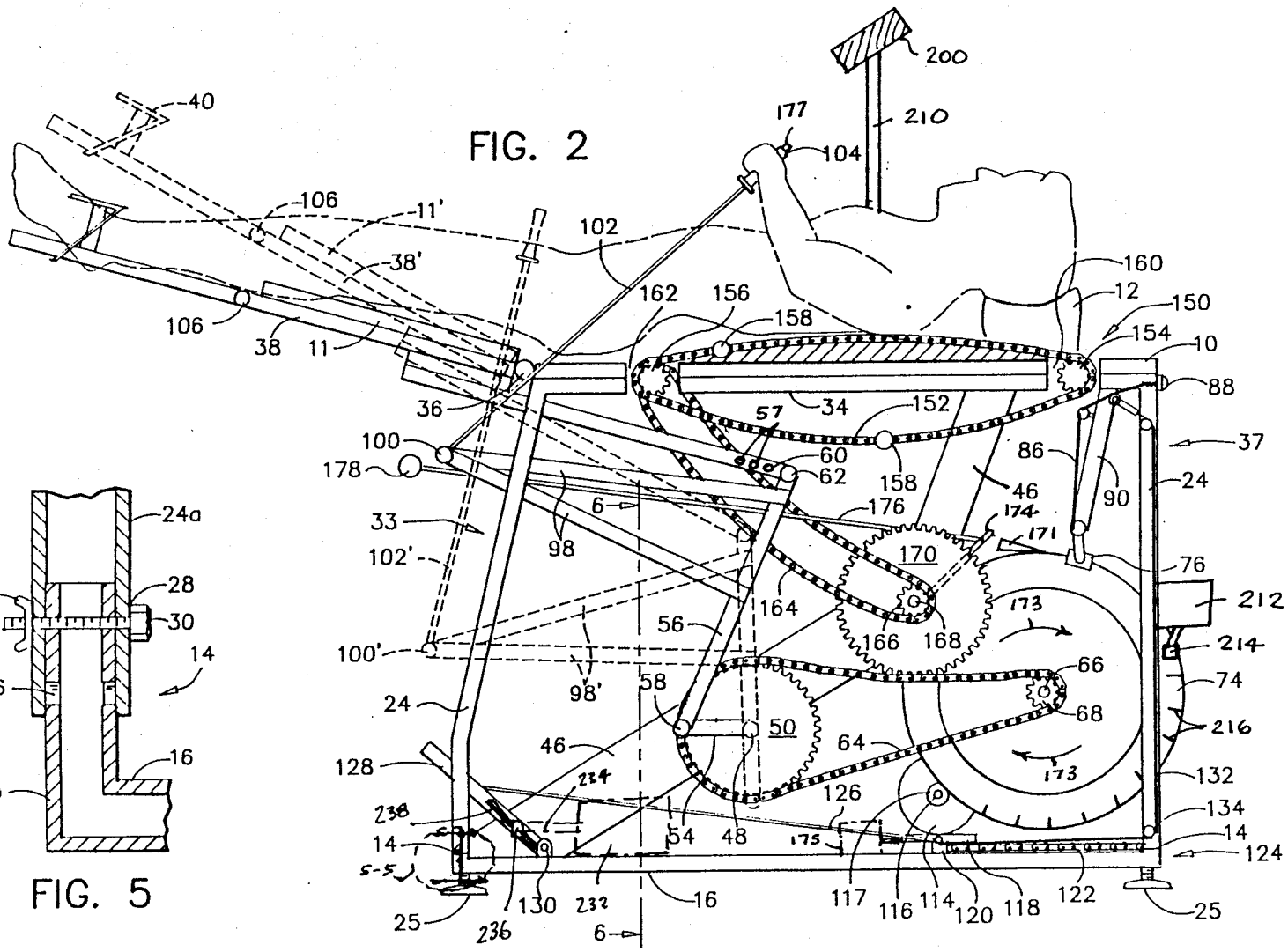
FIG. 2 is a side elevation view of the device with the outer panels removed, also showing the alternate positions of the leg mechanism.
Figure 5:
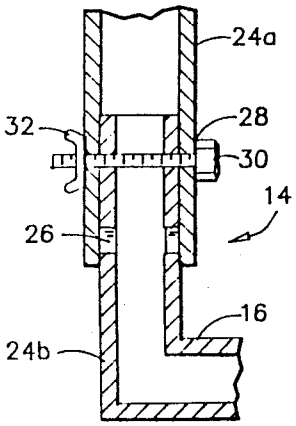
FIG. 5 is a detail sectional elevation view of the telescoping height adjustment means of the apparatus indicated by the dashed line 5-6 in FIG. 4.
Figure 3:
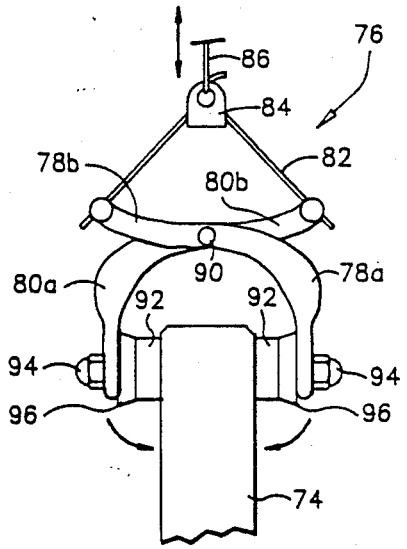
FIG. 3 is a detail view of the retarding mechanism.
Figure 7:
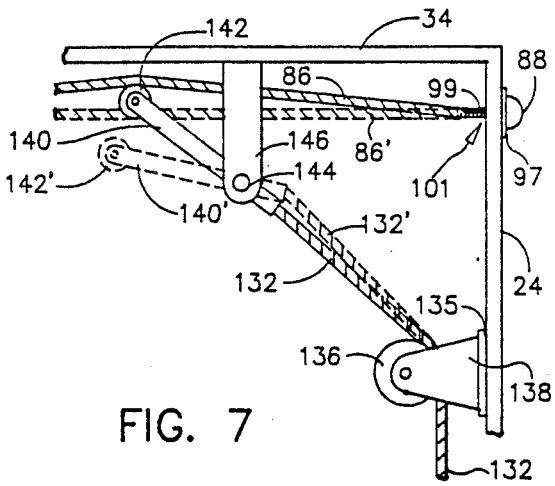
FIG. 7 is a detail elevation view of a portion of the retarding mechanism control means.
Figure 6:
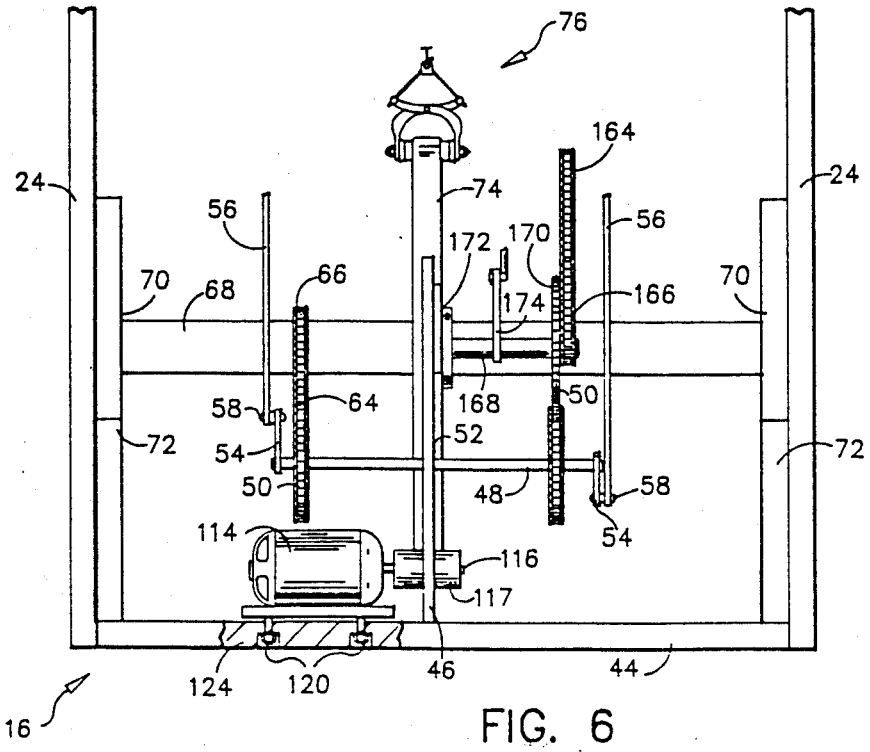
FIG. 6 is an end view, partially cut away, of the lower portion of the apparatus.

FIGS. 2 and 5 illustrate the basic mechanism of the invention. The platform 10 is supported by frame 16 which consists of generally vertical posts 24, which if desired rest on casters 25. In the embodiment shown each post 24, one of which is shown in detail in FIG. 5, consists of a main portion **24*a* and a base portion 24*b* of slightly smaller diameter. Both portions are made of hollow tubular material such as steel or aluminum, and the outer main portion 24*a* telescopes over the base portion 24*b*. A series of vertically aligned holes 26 are drilled through base portion 24*b* and a single alignable hole 28 drilled through main portion 24. The frame posts 24 are then raised and lowered as desired and the elevation of the platform 10 fixed by inserting bolt 30 through hole 28 and one of the aligned holes 26 and then securing the bolt 30, as with wing nut 32. Of course other means of changing height elevation could also be used, such as jack screws or pneumatic or hydraulic piston and cylinder means. Alternatively, the entire framework can be fixed with no height adjustment feature so that the platform 10** remains permanently at a single elevation. As will be evident from the discussion below, changing the elevation of the platform does not affect the operating mechanism since the rotating devices will simply pivot to accommodate the new angles for the drive mechanisms.

The upper part of frame 16 is platform support 34 onto which platform 10 is secured. Mounted at the hip end 33 of support 34 and platform 10 through pivot 36 are leg supports 38 on the right and left sides of the frame 16 respectively. Mounted on leg supports 38 are guides 40 which do not tightly hold the user's ankles but merely keep his legs from sliding sideways off the supports 38. It is not desirable to have the user's legs and ankles bound tightly to the leg supports 38, for that inhibits the proper flexion and extension of the legs during the walking exercise. (One may, however, incorporate a waist or chest belt 204 to restrain the user on the device, or there could be railings 202 or similar "side boards" placed along the sides of the device to keep the user from accidently rolling off the device.) The leg supports 38 may contain a telescoping feature 42 to accommodate users with different leg lengths. This may quite adequately be a simple sliding friction fit between the two telescoping segments.

Each of the leg support mechanisms 38 is linked through the internal mechanism shown in FIG. 2. It will be understood that the two leg mechanisms 38 are identical except for being mirror images of each other and therefore the description herein will be primarily of only a single one of the two mechanisms. The same will be true of the pair of arm exercisers described below, one being on the right side and the other being on the left side of the frame 16. It should also be noted that for clarity not all of the mechanical and support structures are shown on every Figure in which they would normally be visible. Each component does appear in at least one Figure, and the reader skilled in the art will immediately recognize where any given component would be positioned in any of the other views. This manner of illustration permits the operation to be clearly shown since illustration of all components in each Figure would unduly complicate the Figures and cause some of the components to be obscured.

Running diagonal upwardly from end bar 44 of frame 16 is central support 46 which is secured at its upper end to support 34 near the shoulder end 37 of the frame 16. Mounted on support 46 is axle 48 on which are mounted sprocket wheels 50. Axle 48 is journaled in support 46 by an internal bearing 52. Also mounted rigidly on axle 48 are cranks 54 which are offset 180 degrees from each other so that movement imparted to one pair of limbs is the opposite of that imparted to the other pair. Each of the cranks 54 is pivotally mounted to link 56 through pivot 58. Link 56 is in turn pivotally mounted to link 60 through pivot 62. Link 60 is rigidly attached to leg support 38 such that as sprocket wheel 50 revolves, crank 54 and links 56 and 60 cause leg support 38 to reciprocate vertically around pivot 36.

The included angle of the "stride" accomplished by the user is the degree of separation of the two leg structures, as illustrated in FIG. 1. For most people, the included angle of the stride is about the same. For some people, however, hip problems or other physiological reasons limit the included angle they can achieve. The device has the capability of being adjusted to fit the mechanical stride closely to the user's normal stride. This is accomplished by having, a series of holes 57 aligned along the length of link 54 and having the pivot 58 demountable, with an extended pivot pin which can be inserted into any hole along the length of link 54. When the pivot 58 is mounted in the hole closest to the end of link 54, the length of the stride is at its maximum. Shorter strides are obtained by mounting the pivot 58 in the more inwardly located holes on link 54. A lead screw could also be used to adjust the relationship of link 54 and pivot 58 and therefore the degree of stride.

Sprocket wheel 50 is linked by drive chain 64 to sprocket wheel 66 which is fixedly mounted on axle 68 which is journaled in bearings 70 which are supported by posts 72. Also mounted on shaft 70 is flywheel 74. The mass and inertia of flywheel 74 are chosen such that rotation of flywheel 74 assists the user to maintain a normal walking pace. The selection of the gear ratios between sprocket wheels 50 and 66 will determine the relative speed at which flywheel 74 is driven by the user's efforts.

The rotation of flywheel 74 may be retarded by application of brake mechanism 76. Brake mechanism 76 is a conventional caliper brake consisting of opposed caliper arms 78 and 80. Upper portions **78*b* and 80*b* of the caliper arms are connected through cable 82 and bracket 84 to cable 86 which in turn is connected to control 88. Control 88 provides means to retain cable 86 at different positions of extension. This may be by making control 88 in the form of a screw shaft 99 threaded through an opening 101 in plate 97 which spans the end space between the two posts 24 at the shoulder end 37 of the frame 16, such that rotating the control 88 causes the screw shaft 99 to move inwardly or outwardly against plate 97 and put different degrees of tension on cable 86. Alternatively, one could use a simple shaft with detent notches spaced at regular intervals to cooperate with the edges of hole 101 in plate 97 through which the shaft is passed, such that the control could be moved in or out and stopped at any of the desired detents. The caliper arms 78 and 80 are pivoted on shaft 90 so that as cable 86 is pulled the lower portions 78*a* and 80*a* of the caliper arms pivot inwardly. Caliper pads 92 are mounted by bolts 94 against bosses 96 on the inner ends of caliper arms 78 and 80, such that as the caliper arms pivot inwardly pads 92 are pressed against flywheel 74 providing a friction braking effect. The caliper pads 92 are preferably of felt so that the flywheel 74** can be smoothly retarded. Rubber pads could be used but tend to grab.

Brake 76 can be used to keep flywheel 74 from developing excessive speed, particularly when the device is being used by an infirm user. More commonly, however, the device will be used to provide additional resistance against which the fit user works in performing the walking motion. This in effect provides a more vigorous workout, analogous to the type of strenuous walking one would encounter in walking in a pool of water or through soft sand. The advantage here is that the strenuous walking is obtained without the balance problems one encounters in walking in water or sand. It will be evident that a range of degrees of retarding can be obtained by mechanism 76, from no retarding at all (where the caliper pads 92 are out of contact with the flywheel surface) up to sufficiently high frictional retarding that the user must exert his maximum efforts to make flywheel 74 move at all.

The flywheel can also serve as means for automatic adjustment of isokinetic resistance against which the user works. An electronic sensor 214 positioned adjacent the flywheel 74 senses the rotational speed of the flywheel 74 from marks 216 and sends a signal to motor 232 which drives lead screw 234 to move lever 128 by means of nut 236 sliding in groove 238 (all shown in phantom). The sensor can be set within upper and lower flywheel rotational speed limits, such that when the speed drops below the lower set point the friction of the brake against the flywheel is reduced, making it easier for the user to "walk" and move the flywheel. Conversely, when the wheel speed gets above the upper set point, the brake is applied and the user must work harder to move the wheel.

Attached to link 56 is triangular support 98 on the end of which is mounted pivot 100. Pivotally mounted through pivot 100 are arm shafts 102 which terminate in hand grips 104. By gripping hand grips 104 the user's arms move through the normal arm swinging movements of walking. By exerting force against the hand grips 104 and arm shafts 102 the fit user can aid himself in performing the walking movements, in much the same manner as one exerts force against ski poles to assist himself in nordic skiing. The apparatus can also be used for those infirm users who are unable to grasp hand grips 104, by making the hand grips 104 in the form of means to restrain the user's hands and hold them in the proper position so that the mechanism will move the user's arms through the walking, swinging motion even when the user has no control over his arms. Such means could for instance be tight gloves into which the user's hands are fitted and held or a stirrup and strap arrangement where the user's hands are securely strapped to a rigid stirrup and held in place.

In a preferred embodiment the mechanical advantages of the leg and arm linkages are selected such that the walking motion can be initiated and maintained by either the force of the user's legs or arms or both together. The significance of this multi-functional operation is evident. A fit user can operate the apparatus with his legs, his arms, both together or both alternately. An infirm user who does not have control of or strength in his arms can drive the apparatus with his legs alone, and both his arms and legs receive the benefit of the walking motion, which he would not otherwise be capable of. Conversely, an infirm user who does not have control of or strength in his legs can drive the apparatus with his arms alone and get full benefit. Similarly, only a single limb can drive the mechanism, such that the other three limbs are carried through their range of motion without effort.

Figure 4:
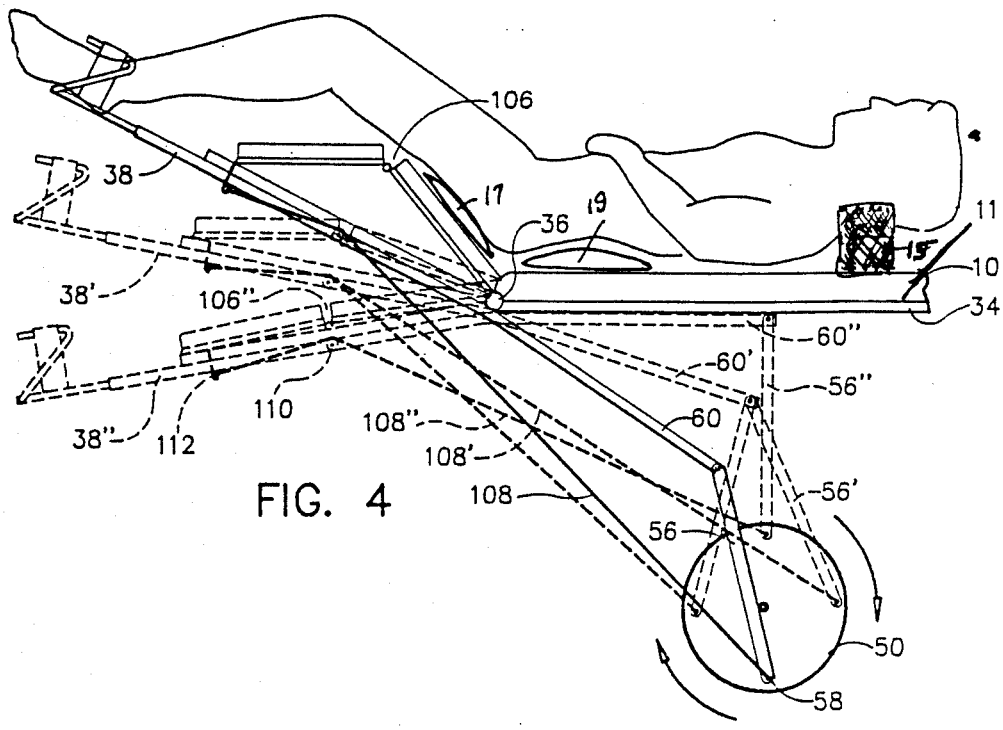
FIG. 4 is a detail side elevation view of one type of leg flexing mechanism.

One knee flexing mechanism is shown in FIG. 4 and consists of a lateral hinge 106 which is placed in leg support 38 and a cable 108 which is secured at its inner end to pivot 58 on sprocket wheel 50, threaded over idler wheel 110 (which is secured to the underside of support 38 inwardly of hinge 106) and secured at its outer end 112 to the underside of the outer portion of leg support 38. Thus as the sprocket wheel 50 revolves cable 108 is alternately pulled and released causing the leg support 38 to flex at hinge 106. As will be observed from the drawing, cable 108 is at its slackest when the leg support 38 is in the lowest position, thus having the user's leg fully extended at the low position. As the leg support 38 moves upwardly simulating the forward motion of a step, the cable 108 is tightened and the leg support 38 is bent at hinge 106, causing the leg to flex in the normal walking pattern. Normally gravity and the weight of the leg support 38 are adequate to cause the leg support 38 to resume its extended position on its downward movement as cable 108 is slackened, since hinge 106 is relatively loosely fitting and pivots freely. If a more positive means is desired for returning the leg support 38 to an extended position on the downward stroke, one could readily spring load hinge 106 so that as cable 108 is slackened a torsion spring urges the leg support 38 back into an extended position.

The operation of the device by a user is evident from the drawings. The user lays supine on the support 10 with his arms grasping handgrips 104 and his legs positioned on leg supports 38. He then begins the normal walking motions by pressing one arm or leg downward. This movement transmitted through links 60 and 56 to crank 54 causes sprocket wheel 50 to begin to rotate. Rotation of sprocket 50 in turn drives rotation of flywheel 74 through chain 64. The user alternates pressing downward with each arm or leg, quickly overcoming the inertia of the mechanism and coming to a normal walking pace. The force necessary to cause the walking pace is adjusted by regulating brake mechanism 76. The hands can move passively with the motion of the arm shafts 102 or the user can use his arms to participate actively in walking by his force on the shafts as in nordic skiing. Once a comfortable walking pace is reached a user can continue with the walking motions for prolonged periods, thus obtaining the benefits of extended walking but without any axial spinal loading and without incurring any foot or knee fatigue. Since the user can set his own pace he can walk comfortable for much longer periods than would be possible in normal walking since he is freed of many spine, foot and other joint limitations. He can also adjust the retarding mechanism 76 to require any desired degree of pressure with his legs and arms to maintain the mechanism in motion by overcoming the inertia of flywheel 74 and the retarding effects of brake mechanism 76.

It is important for the correct functioning of the knee flexure mechanisms that the flywheel turn in the same direction each time. With the linkages shown in the drawings, the wheel must rotate as shown by arrows 173. To avoid a start in the wrong direction, two mechanisms are contemplated. First, a one-way brake 171 in the form of a wedge rides freely on the periphery of flywheel 74 and is pivotally attached to support 46 (by means not shown). Reversal of flywheel 74 from its normal rotation causes brake 171 to dig into the edge of the flywheel 74 and stop its rotation. In addition, or alternatively, a solenoid 175 (shown in phantom) attached to a source of electricity and controlled by a button 177 in hand grip 104, can be extended momentarily to move motor 114 and cause shaft 116 to briefly engage flywheel 74 and, with motor 114 also being activated by the source controlled by button 177, start flywheel 74 moving in the proper direction. Lever system 126/128 would have to be disengaged.

The various control knobs, levers, buttons and the like may be placed at convenient locations where they may be operated by the user and/or an attendant or therapist. Some typical locations are shown; others include the head board 209 or a panel beside the user's hips. The controls do not all need to be located together. Wherever a control is located it will be connected by suitable mechanical and/or electrical means to the portion of the device that it operates.

Figure 8:
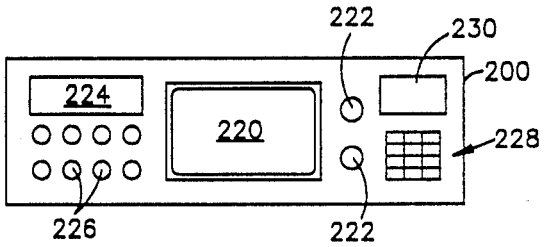
FIG. 8 is a front elevation view of a monitor to be mounted on the device of this invention.

One convenient location for the controls for the device is overhead control panel (or monitor) 200 which is positioned such that the user can easily manipulate the controls while lying on the device. This unit may also contain the various meters, digital readouts and other indicators that allow the user to monitor his progress. There are many suitable configurations for the control panel; one typical example is shown in FIG. 8. In this embodiment there is a centrally located video screen 220 with video controls 222 adjacent. The specific controls used will of course depend on whether the video screen is to display video tapes or television programming or both. Shown to the left of the video screen is a multi-functional computer system digital display unit 224, with a series of buttons 226 for the user to select the specific measurement he wishes to display, such as walking speed, pulse rate, heart rate, time of day, elapsed exercise time, resistance level, and so forth. To the right of the video screen is a numeric keypad 228 with its associated LCD or LED readout 230, to permit the user to enter into the computer the data needed for appropriate computer software to calculate his exercise program.

The ability to adjust the apparatus for a degree of resistance with the flywheel permits it to be used for high level physical training in a much more convenient manner than is conventionally possible. In normal high level training the athlete must use added weights on his ankles and/or wrists and also commonly walks or runs up inclined ramps, treadmills or steps to increase the amount of effort he must maintain. With the present apparatus he can get all of the benefits of the high level training against strong resistance without having to endure the disadvantages of increased body loading or trying to find an appropriate training location.

The unit can be power driven for use with infirm users if desired. This allows users who are wholly or partially paralyzed to obtain the muscle tone benefits that a normal individual obtains through walking. Electric motor 114 with motor shaft 116 is mounted on moveable base 118 which slides or rolls on tracks 120. Base 118 is secured to a tension spring 122 which in turn is anchored at its opposite end to crossbar 124 at the shoulder end of base 16. Base 118 is also secured to rod 126 which in turn is attached to lever arm 128, which is pivoted on pivot 130 attached to base 16. On shaft 116 is mounted friction wheel 117 which is positioned to contact and drive the outer rim of flywheel 74 when lever arm 128 is in a raised position and rod 126 is pushed back, with the urging of tension spring 122 aiding in maintaining positive contact of flywheel 74 and friction wheel 117. Motor 114 is powered by conventional electrical supply means (not shown) including an off/on switch 177 in hand grip 104. If desired, one could substitute a variable speed controller for the off/on switch so that the speed of rotation of the flywheel 74 could be varied. Alternatively, the motor 114 could be a variable speed motor. When the motor drive is not to be used, the motor shaft 116 and friction wheel 117 must be disengaged from contact with the flywheel periphery so that unwanted frictional drag is not placed on the flywheel nor is the motor damaged. This is accomplished by pushing down on lever 128 which through rod 126 pulls movable base 118 and the attached motor 114 away from flywheel 74. Lever 128 is preferably an over-the-center device which can be locked in the lowered position. Alternatively, other means could be provided to lock down lever 128, such as a simple detent on post 24 into which lever 128 is moved or a hook mounted on post 24 which engages a hole or lug on lever 128. The aforementioned solenoid could also perform this function.

When the motor drive is engaged it is necessary that the brake mechanism 76 be completely disengaged from the flywheel 74. If the brake were engaged and retarded the flywheel 74, motor 114 would be quickly burned out. This is accomplished by use of cable 132 which is attached to base 118 and pivoted around idler wheel 134. Cable 132 passes up and around idler wheel 136 which is journaled on bracket 138 attached to crossbar 135. Cable 132 is secured to the end of pivot arm 140 which has idler wheel 142 journaled on the opposite end thereof. Pivot arm 140 is pivoted on shaft 144 journaled in bracket 146. When drive motor 114 is engaged with flywheel 74 slack is introduced into cable 132 and pivot arm 140 swings to its lower position indicated at 140' where it is out of engagement with cable 86. This introduces slack into cable 86 (as indicated at 86') thus releasing the pull on caliper arms 78 and 80 and causing brake mechanism 76 to disengage from flywheel 74. When motor 114 is pulled out of engagement with flywheel 74 by the action of lever arm 128, tension is introduced into cable 132 which pulls pivot arm 140 into a raised position where idler wheel 142 engages cable 86 and forces it upward, causing the slack to be removed from cable 86 and making it responsive to the movements of adjusting control 98 for operation of caliper arms 78 and 80 of brake mechanism 76.

Since the apparatus can provide passive limb movements, it can be very useful in stress and sleep therapies. The passive motions induce body relaxation in the user, which is important in creating body relaxation, which promotes stress reduction and sleep enhancement.

As an optional feature one may also include back massaging mechanism 150. This consists of endless chain 152 which is looped around sprocket wheels 154 and 156 and contains balls or similar massaging devices 158 spaced along the length of chain 152 at regular or irregular intervals. Sprocket wheels 154 and 156 are mounted on the center line of unit 2 and passed through holes 160 and 162 cut in platform 10 (and any padding 11) so that chain 152 and balls 148 move axially along the user's back and massage his spinal area. If desired, there may be a plurality of chains 152 running in parallel, all driven from sprocket wheels journaled in parallel on the same axle with sprocket wheels 154 and 156, to provide additional points of massage of the user's back. Alternatively the balls 158 may be replaced by rods mounted laterally to the chain so that a wider area of the user's back is massaged by a single mechanism. The massaging apparatus 150 is driven by chain 164 which engages sprocket wheel 166 which is mounted on axle 168. Also mounted on axle 168 is sprocket wheel 170 which has teeth positioned to operably engage with chain 64. Axle 168 is mounted on a swiveling cam mechanism 172 which in turn is secured to support 46. Also mounted on axle 168 is lever arm 174 to which is pivotally mounted link 176. Link 176 passes through a bracket (not shown) on the hip end 33 of frame 16 and terminates in knob 178. Detents are cut into link 176 to engage with the bracket so that the sprocket wheel 170 can be either in an engaged or disengaged position with chain 64. When the knob 178 is pulled outward the linkage 176 and lever arm 174 cooperate with cam mechanism 172 to pivot shaft 168 and sprocket wheel 170 away from chain 64. By means of a detent the mechanism can be locked in the disengaged position. When it is desired to operate the massage mechanism 150 link 176 is pushed back in until another detent locks it in the engaged position. Thereupon operation of sprocket wheel 50 and chain 64 by the user will cause sprocket wheel 174 to be driven in turn driving chains 164 and 152 to provide the back massage to the user.

It will also be advantageous to use this invention in conjunction with the continuous passive motion ("CPM") device which is the subject of applicants' copending application Ser. No. 06/871,319. This device is indicated schematically in FIG. 4, where the inflatable bladders for the neck, lower back and buttocks are shown at 15, 19 and 17, respectively. By use of conventional synchronization means, one can operate the current walking device and the CPM device to coordinate the walking motion with appropriate intermittent cervical and lumbar traction, continuous passive motion at various points along the spine, head and neck rotation, and/or hip and shoulder rotation. Alternatively, mechanical means could be used to accomplish these coordinated movements, but such mechanical means are necessarily complex and the much simpler CPM device is therefore preferred.

Figure 9:
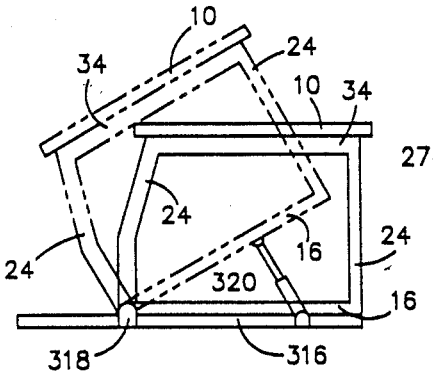
FIG. 9 is a schematic side elevation view showing means of elevating the device of this invention.

FIG. 9 illustrates schematically means for tilting the device of this invention to more closely simulate actual walking posture. The frame made up of members 16/24/34 is mounted on a separate base 316 to which is attached pivot 318, on which the frame pivots upwardly. A piston and cylinder 320 is mounted on base 316 and connected to the bottom 16 of the frame; these operate in a manner analogous to the hydraulic mechanism used to raise dump truck bodies or similar devices which pivot upwardly at one end. The unit may be titled so that the platform 10 is from horizontal (0°) up to 45° to the horizontal. Horizontal (0°) is preferred, and if tilted, the preferred angles are up to 15°, preferably not more than 7° from the horizontal. The degree to which the device is pivoted upwardly from the horizontal will depend on the type of exercise involved and the user's physical condition. There is of course a physiological trade-off involved here, since as the device is pivoted upwardly the user's spine comes under increasingly greater axial loading. When the unit is pivoted upwardly, the user will need to be restrained as by belt 204 so that he will not slide out of his position on the device. Restraining rails or a body harness will also accomplish the required restraint.

Figure 10:
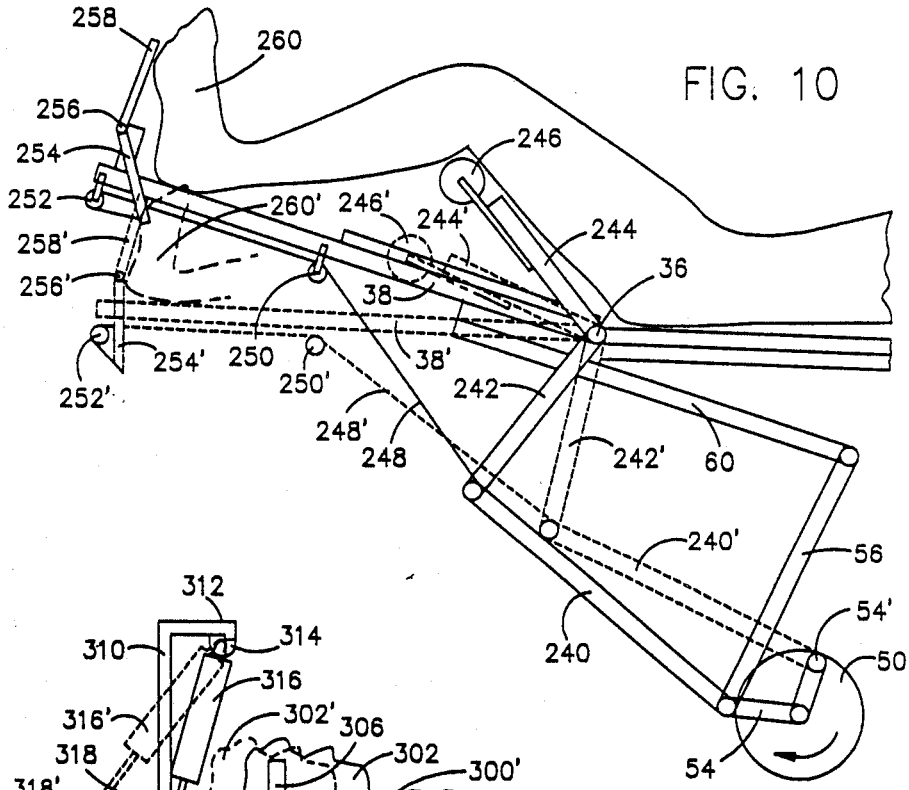
FIG. 10 is a partial side elevation view showing means for providing a foot strike mechanism in association with a leg flexing mechanism as part of the device of this invention.

FIG. 10 illustrates means for providing a "foot strike" capability to the device of the invention. In a normal walking gait, a person rocks forward on the ball of one foot as he straightens his leg and swings the other leg forward. As the leg which is moving forward strikes the ground and begins to straighten, the weight is taken off the ball of the other foot and that leg begins to flex preparatory to its moving forward in the next part of the stride. In the present invention, this foot strike can be reproduced by the mechanism of FIG. 10 which is integrated with a leg raising and flexing mechanism similar to that shown in FIG. 4. Members 240 and 242 are pivotally linked to crank 54 and wheel 50. As the wheel 50 turns and moves the leg support 38 up and down through links 56 and 60 and pivot 36, it moves arms 240 and 242 which also pivot on pivot 36 and raise and lower thigh support 244 to which is attached knee flexure roll 246 (in FIG. 10 the primed numbers indicate the lowered position of the various members as indicated in phantom).

Connected to arm 242 is cable 248 which passes over idler 250 and reversing idler 252. After reversing its direction after passing over reversing idler 252, cable 248 is fixed to the end of lever arm 254 which is pivoted on pivot 256 and joined to foot plate 258. Cable 248 will normally incorporate spring 249 to control slack in the cable 248. As the mechanism moves so that the leg moves downward and becomes extended, arm 242 moves backward toward position 242', pulling on cable 248 and causing lever arm 252 to move foot plate 258 upward to put a load against the ball of the user's foot 262. As the leg support moves back upward, arm 242 is moved distally and the knee flexure roll 246 causes the knee to flex, while the tension is lessened on cable 248 and the force is taken off the ball of the foot 260. If desired, a torsion spring can be mounted at pivot 256 for a positive return of the foot plate 258 to an unloaded position. This mechanism thus provides an accurate simulation of the normal "foot strike" loading of the ball of the foot as the leg extends in the normal walking stride and removal of that force as the leg flexes and moves upward and forward in the normal stride.

Figure 12:
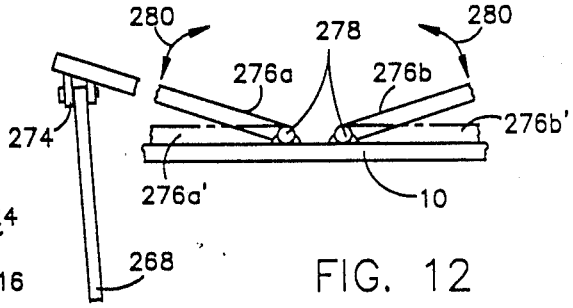
FIG. 12 is a partial end elevation view of the means of FIG. 11.
Figure 11:
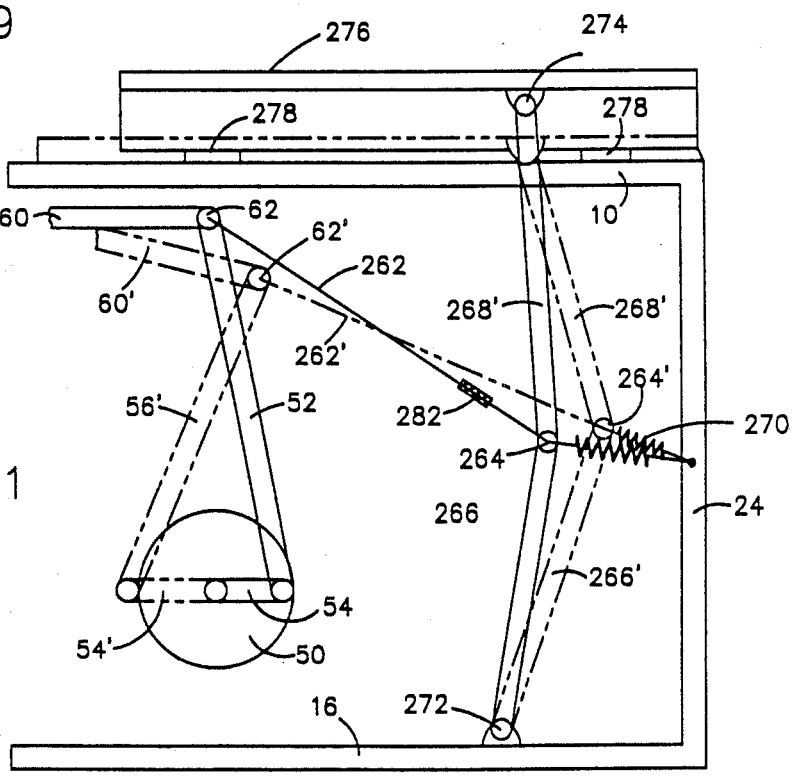
FIG. 11 is a partial side elevation view of a means for providing rocking motion to the body of a user of the device of this invention.

FIGS. 11 and 12 are two views of a mechanism which can be incorporated into the device of this invention to provide a "rocking" motion which simulates the normal rotation of the body around its vertical axis as the person walks. Cable 262 is fixed to pivot 62 at the joint between links 56 and 60. At the other end, cable 262 is attached to joint 264 between two members 266 and 268 which are arranged in a form of a toggle. At its lower end, member 266 is attached to pivot 272 which is connected to base 16, while at the upper end member 268 is attached to pivot 274 which is joined to body support platform 276. The body support platform 276 is in two parts designated **276*a* and 276*b* aligned parallel to the spinal axis of the body and separated at the centerline of the body, as indicated in FIG. 12. Each half platform 276*a* and 276*b* is mounted by hinges 278 to underlying platform 10 so that the body support platforms 276*a* and 276*b* can be pivoted in a shallow arc as indicated by arrows 280. The toggle formed by members 266 and 268 is duplicated by an identical toggle on the other side of the body (not shown). This second toggle is fixed to the opposite pivot 62 on the leg mechanism on the other side of the device so that the platforms 276*a* and 276*b*** operate in an alternating fashion so that one rises while the other is lowered. Thus, the normal rotational motion around the spinal axis of the body is duplicated.

The degree of rotation obtained can be adjusted by changing the length of the cable 262. For instance, a turnbuckle 282 could be included in the cable so that it can be shortened or lengthened. The longer the cable the less it will pull on the toggle and the less the platforms 276 will be raised. Changing the length of members 266 and/or 268 will accomplish the same result but is mechanically much more difficult and does not permit rapid individual adjustment for each user. It is also helpful to have spring 270 attached to frame 24 and pivot 244 to assist in returning the platform 276 to its horizontal position. Platform 276 may, of course, have padding such as 11 on it for the user's comfort.

Figure 13:
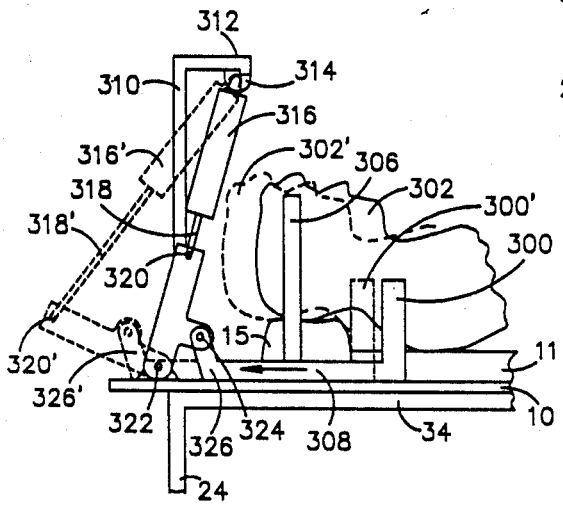
FIG. 13 is a partial side elevation view of a means of providing neck traction to a user of the device of this invention.
Figure 15:
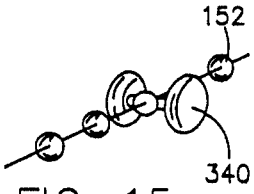
FIG. 15 is a partial perspective view of the driving mechanism of the means of FIG. 14.
Figure 14:
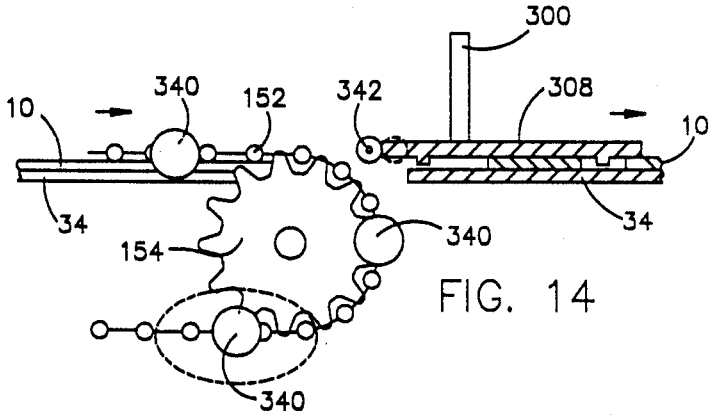
FIG. 14 is a partial side sectional elevation view of another means of providing neck traction to a user of the device of this invention.

FIGS. 13 to 15 show two different versions of a neck traction device which can be incorporated into the device of this invention. The traction portions are essentially the same, with the operating mechanisms being different. The basic neck traction mechanism is shown in FIG. 13. It includes a yoke 300 which fits around the user's neck and base of the head at 302 and which when moved horizontally pulls the user's head and neck in the superior direction to stretch the cervical portion of the spine. Some form of restraint for the user's body is necessary for the traction mechanism to work effectively; belt 204 or some form of body harness will be quite satisfactory. It is also helpful to have head strap 306 to help restrain the user's head during the traction.

Head strap 306 is connected to the sliding base 308 to which neck yoke 300 is also joined. This base 308 slides on platform 10. Bladder or pillow 15 may be used to support the user's head and provide comfort. Other bladders or pillows 17 and 19 may also be used for the user's comfort in any of the embodiments.

In the embodiment shown in FIG. 13 an upwardly extending arm 310 is mounted on platform 10. Arm 310 has a horizontal extension 312 which terminates in bracket 314 to which is pivotally mounted cylinder 316 which encloses piston 318. Piston 318 is pivotally mounted to overarm toggle 320 which is hinged to pivot 322 mounted on platform 10. It is also pivotally mounted at pivot 324 to the superior end 326 of base 308. As the piston is activated and extends, its pushes overarm toggle 320 in a superior direction pulling the base 308 in the same direction and applying traction to the user's neck. The degree of direction to be applied will be determined by the amount of extension of the piston 318. Similarly, the speed with which the traction is applied will be determined by the speed of extension of piston 318. The piston and cylinder will be a reversible unit so that positive release of the traction is obtained by retraction of the piston 318 which moves the overarm toggle 320 and base 308 back in an inferior direction.

Another embodiment of the neck traction which operates in conjunction with back massage mechanism 150 is shown in FIGS. 14 and 15. Mounted on chain 152 at spaced intervals are "dumbbells" 340. In FIGS. 14 and 15 the chain 152 is shown as a ball-and-link chain while in FIG. 2 it is shown as a bicycle type chain. Either type is quite satisfactory, as are other common chain structures. As the unit operates and the chain is moved for the back massage, dumbbells 340 progress along the chain path and serially contact roller 342 which is mounted on the inferior end of base 308 below yoke 300.

Those skilled in the art will immediately recognize that other helpful accessories can be used with this device. For instance, a counter can be attached to sprocket wheel 50 (or axle 48) to indicate the number of revolutions of sprocket wheel 50, which is equivalent to the number of steps taken by the user. By knowing the length of the user's normal stride, this can readily be translated into distance walked and the indicator driven by the counter can be calibrated in meters, miles or other distance units and displayed on monitor 200 so that the user can tell at a glance how far he has walked. Sensors can also be incorporated into the brake caliper mechanism to indicate the amount of pressure exerted by the caliper pads 92 against the flywheel 74. Since the frictional characteristics of the flywheel surface and caliper pad surfaces remain relatively constant, the pressure exerted against the flywheel 74 by the pads 92 can be converted into the amount of frictional drag on the flywheel 74 and that value can be indicated by a meter or readout on monitor 200 to give the user an indication of the amount of resistance he must overcome to maintain the walking movements.

A speedometer and/or odometer can be integrated with the flywheel and displayed on the overhead console 200 to indicate to the user how fast he is walking and how far he has walked. Such a device is shown in FIG. 2, and has an optical sensor 214 integrated with a timer to determine the frequency at which the regularly spaced lines 216 on the flywheel 74 pass the sensor 214, which can be directly converted to the speed of the flywheel 74 and the "walking" speed of the device.

The timer is incorporated into module 212 which also includes circuitry to control the isokinetic resistance by generating the appropriate speed related signals to motor 232 as described above. Strain gauges can be incorporated into the leg structures 38 and/or the arm structures 102 to measure the amount of force exerted by the user on each of these components. This will allow comparison of leg-to-leg, arm-to-arm or leg-to-arm strength ratios. It will also permit quantitative measurement of weakness in any of the limbs, as compared to the other limbs.

A clock or timer can be integrated with the brake mechanism to stop the device when the user has reached the desired limit of his exercise. Alternatively the clock or timer may not actually shut down the device, but would only provide a visible or audible signal that the predetermined exercise time had elapsed, so that the user could himself terminate the exercise session, either immediately or gradually.

For the comfort or entertainment of the user while he exercises, one could attach an audio tape or disk player, with speakers 208 or earphones for the user. One could also include a video monitor in the console 200, attached to a video tape player or television receiver, such that the user could watch video tapes or television programs while exercising.

Heart rate monitors, blood pressure monitors, pulse monitors, thermometers and the like can also be attached to the device, to be worn or used by the individual while exercising. These can provide visual indications of status on the overhead console 200, or, in an institutional setting, provide through suitable transmission means indications to status at a remote location such as a nurses' station; these could also be integrated with alarm features so that attending medical personnel would be immediately aware of any abnormalities in heart function, body temperature and so forth.

Auxiliary devices such as cooling fans, heating pads and vibrators may also be used with the device.

Electrical muscle stimulation may be integrated with the walking motion of the device, so that the simulation means operates to stimulate the chosen muscles at the appropriate time. Such stimulation would typically be used for the back and buttocks muscles.

Many of these functions can be accomplished with aid of a computer, using software which personalizes an exercise program for each user, once having been provided with data on the user's age, size and physical condition. Such a program could through conventional electrical and mechanical means control the operation of the device to maintain the exercise pattern within the proper limits for the individual user, or to provide gradual and progressive increases in the amount and effort of the exercises so that the user's physical condition is improved over time at an appropriate rate. The computer could also, through conventional printer means, provide the user (or his physician or therapist) with a permanent written record of exercise activity and progress.

It is evident that there are numerous embodiments of this invention which are not described specifically above but which are clearly within the scope and spirit of the invention. Consequently, the above description is to be considered exemplary only and the invention is to be limited solely by the appended claims.

We claim:

1. Apparatus to permit a person to perform coordinated motions of walking while maintaining his or her spine in an at least partially free of axial gravitational loaded state, which comprises:

a rigid frame including a generally flat platform at the top thereof, said platform having a surface to support said person from the hips superiorly in a supine position with at least reduced gravitational loading axially along said person's spine, said frame having a right side, a left side, an axial centerline, a shoulder end and a hip end, all corresponding to the location of the counterpart portions of said supported person's body;

a pair of leg supports, each support pivotally mounted to the hip end of said frame and pivotable in a vertical plane, one support disposed on the right side and one support disposed on the left side of said centerline;

a pair of arm exercisers, one disposed on the right side and one disposed on the left side of said centerline, the arm exercisers each consisting essentially of an elongated member positioned substantially perpendicular to the flat platform and having a handgrip disposed at one end thereof, the handgrip being adapted to be engaged by the hand of a person, said arm exercisers being adapted to move in a generally vertical plane and being positioned to maintain the person's natural wrist and elbow angle with the arms substantially unsupported while performing the motion of walking;

linkage means for joining said arm exercisers and leg supports to cause the right side arm exerciser and left side leg support to move vertically and synchronously in one direction and the left side arm exerciser and right side leg support to move vertically and synchronously in the other direction when said apparatus is activated; and inertial means, connected to the linkage means for maintaining the synchronous opposed movement of said leg supports and arm exercisers for a period of time while said person remains in said supine position with said spine in said state of at least reduced axial loading.

2. Apparatus to permit a person to perform coordinated motions of walking while maintaining his or her spine in an at least partially free of axial gravitational loaded state, comprising:

a rigid frame including a generally flat platform at the top thereof, said platform having a surface to support said person from the hips superiorly in a supine position with at least reduced gravitational loading axially along said person's spine, said frame having a right side, a left side, an axial centerline, a shoulder end and a hip end, all corresponding to the location of the counterpart portions of said supported person's body;

a pair of leg supports, each support pivotally mounted to the hip end of said frame and pivotable in a vertical plane, one support disposed on either side of said centerline, and each support having a lateral hinge therein at the location corresponding to the position of the user's knee;

a pair of arm exercisers, one disposed on each side of said centerline, said arm exercisers being connected to the frame by pivots located remotely from the person's arms and being adapted to move in a generally vertical plane allowing the person to freely move his arms, each arm exerciser having means for engaging the person's hands whereby the person's wrists are placed at a natural angle;

linkage means pivoted on said frame for joining said arm exercisers and leg supports, said linkage means including a first set of links joining the right side arm exerciser and right side leg support and a second, separate set of links independently joining the left side arm exerciser and left side leg support, said linkage means further including means for interconnecting said first and second sets of links so that the right side arm exerciser and the left side leg support move vertically in one direction while said left side arm exerciser and right side leg support move vertically in the opposite direction; and inertial means for maintaining the synchronous opposed movement of said first and second sets of links for a prolonged period of time while said person remains in said supine position with said spine in said state of at least reduced axial loading.

3. Apparatus to permit a user to perform coordinated motions of walking while maintaining his or her spine in an at least partially free of axially gravitational loaded state, comprising:

a. a rigid frame having a right side, a left side, an axial centerline, a shoulder end and a hip end and including a generally flat two-piece platform at the top thereof, one piece of the platform disposed on either side of the axial centerline of the frame and the pieces being hinged along the axial centerline of the frame, the platform having a surface to support the user from the hips superiorly in a supine position axially along the user's spine with at least reduced gravitational loading;

b. a pair of leg supports, each support pivotally mounted to the hip end of the frame and pivotable in a vertical plane, one support disposed on the right side and one support disposed on the left side of the axial centerline;

c. a pair of arm exercisers, one disposed on the right side and one disposed on the left side of the axial centerline, the arm exercisers being connected to the frame by pivots located remotely from the person's arms and being adapted to move in a generally vertical plane;

d. linkage means pivoted on the frame for joining the arm exercisers and leg supports, the linkage means including a first set of links joining the right side arm exerciser and the right side leg support and a second set of links joining the left side arm exerciser and the left side leg support, and the linkage means further including means for interconnecting the first and second sets of links so that the right side arm exerciser and left side leg support move vertically in one direction and the left side arm exerciser and right side leg support move vertically and synchronously in the opposite direction;

e. inertial means for maintaining motion of the linkage means after the linkage means has been activated; and f. means for pivoting each piece of the platform relative to the other piece of the platform, wherein the pieces are pivoted along the hinge upwardly from the frame and simultaneously with the vertical movement of the leg support disposed on the same side of the axial centerline, whereby the user's body is rotated as part of the walking motions.

4. Apparatus as in claim 1 or 3 wherein each said leg support is jointed at a position corresponding to the location of said person's knee and further comprising means to cause said leg support to pivot at said joint as said leg support moves vertically such that said person's leg is alternately in extension and flexion.

5. Apparatus as in claim 1 wherein the linkage means is activated when said person manually performs walking motions while said person's legs engage said leg supports or said person's hands engage said handgrips of the arm exercisers.

6. Apparatus as in claim 1, 2 or 3 wherein the linkage means is activated by application of an external motive force to said linkage means or to said inertial means.

7. Apparatus as in claim 5 further comprising retarding means applied to said inertial means to provide force opposing said person's manual performance of said walking motions, whereby said person must exert added force during said performance to overcome said opposing force of said retarding means and maintain said apparatus in operation.

8. Apparatus as in claim 7 wherein said retarding means is adjustable to provide different amounts of opposing force applied to said inertial means.

9. Apparatus as in claim 1, 2 or 3 further comprising means to provide massage to said person's spine during said walking motions.

10. Apparatus as in claim 1, 2 or 3 wherein said inertial means comprises a flywheel.

11. Apparatus as in claim 10 further comprising retarding means applied to said flywheel means to provide force opposing said person's manual performance of said walking motions, whereby said person must exert added force during said performance to overcome the opposing force of said retarding means and maintain said apparatus in operation.

12. Apparatus as in claim 11 wherein said retarding means comprises an adjustable caliper brake to provide different amounts of opposing force applied to said flywheel.

13. Apparatus as in claim 10 wherein said linkage means is activated by application of an external motive force to said flywheel, said external motive force comprising an electric motor having its drive shaft frictionally engaged with the periphery of said flywheel.

14. Apparatus as in claim 13 further comprising means for preventing said retarding means from engaging said flywheel while said external motive force is applied to said flywheel.

15. Apparatus as in claim 2 wherein said hand engagement means for said arm exercisers comprise means to secure an infirm user's hands.

16. Apparatus as in claim 2 further comprising pivoting means to cause said leg support to pivot at said hinge as said leg support moves vertically such that said person's leg is alternately in extension and flexion.

17. Apparatus as in claim 16 wherein said pivoting means comprises a cable cooperating with said linkage means which is alternately tightened and slackened to pull and release said leg support outwardly of said hinge, causing said leg support to pivot and extend with each cycle of said linkage means.

18. Apparatus as in claim 17 wherein said extension of said leg support is urged by gravity as said leg support moves downwardly.

19. Apparatus as in claim 17 wherein said extension of said leg support is urged by a torsion spring cooperating with said hinge when said leg support moves downwardly.

20. Apparatus as in claim 1, 19 or 3 wherein said platform can be disposed horizontally or at an angle.

21. Apparatus as in claim 2 further comprising foot strike means at the distal end of each of said leg supports for applying elastic resistance to the ball of said person's foot.

22. Apparatus as in claim 1, 2 or 3 further comprising means to exert a force in a superior direction against said person's neck intermittently as said walking motions proceed.

23. Apparatus as in claim 1, 2 or 3 wherein said frame comprises height adjustment means.

24. Apparatus as in claim 23 wherein said height adjustment means comprises a telescoping means incorporated into said frame.

25. Apparatus as in claim 1 further comprising monitor means to visually display information related to said person's walking motions while using said apparatus.

26. Apparatus as in claim 1 or 3, wherein each leg support comprises knee flexure means for providing natural flexion of the knee during the performance of the motions of walking.

27. Apparatus as in claim 1, 2 or 3, wherein each leg support comprises telescoping means for providing adjustability of the leg support.

* * * * *